US011174768B2

(12) United States Patent
Naclerio

(10) Patent No.: US 11,174,768 B2
(45) Date of Patent: Nov. 16, 2021

(54) EXHAUST SYSTEM FOR AN INTERNAL COMBUSTION ENGINE

(71) Applicant: FERRARI S.p.A., Modena (IT)

(72) Inventor: Francesco Naclerio, Belluno (IT)

(73) Assignee: FERRARI S.p.A., Modena (IT)

( * ) Notice: Subject to any disclaimer, the term of this patent is extended or adjusted under 35 U.S.C. 154(b) by 0 days.

(21) Appl. No.: 16/942,184

(22) Filed: Jul. 29, 2020

(65) Prior Publication Data

US 2021/0033008 A1 Feb. 4, 2021

(30) Foreign Application Priority Data

Jul. 30, 2019 (IT) ..... 102019000013317

(51) Int. Cl.
*F01N 1/16* (2006.01)
*F01N 1/18* (2006.01)
(Continued)

(52) U.S. Cl.
CPC ..... *F01N 1/165* (2013.01); *F01N 1/166* (2013.01); *F01N 1/168* (2013.01); *F01N 1/18* (2013.01); *F02D 9/04* (2013.01); *F02D 9/06* (2013.01); *F02D 9/101* (2013.01); *F01N 2240/36* (2013.01); *F02D 2200/101* (2013.01)

(58) Field of Classification Search
CPC ..... F01N 1/165; F01N 1/166; F01N 1/168; F01N 1/18; F01N 2240/36; F02D 9/04; F02D 9/06; F02D 9/101; F02D 2200/101
See application file for complete search history.

(56) References Cited

U.S. PATENT DOCUMENTS 4,609,068 A 9/1986 Backlund
5,406,790 A * 4/1995 Hirota ..... F01N 3/0878 60/276
(Continued)

FOREIGN PATENT DOCUMENTS

DE 102009051098 A1 5/2011
DE 102014003442 A1 * 9/2014 ..... F02D 9/106
(Continued)

OTHER PUBLICATIONS

"What Is a Muffler Delete," Aug. 29, 2018, Bud's Muffler & Auto Service (Year: 2018).*
(Continued)

*Primary Examiner* — Audrey B. Walter
(74) *Attorney, Agent, or Firm* — Cantor Colburn LLP

(57) ABSTRACT

An exhaust system for an internal combustion engine; the exhaust system comprises: at least one an exhaust duct, which originates from the internal combustion engine; at least one exhaust gas treatment device, which is arranged along the exhaust duct; and a silencing device, which is arranged along the exhaust duct downstream of the exhaust gas treatment device. The silencing device comprises a silencing valve, which intercepts the exhaust duct and is movable between a completely open position and a completely closed position. In the completely closed position, the silencing valve has a first free section for the passage of the exhaust gases having a first area other than zero, so that the exhaust gases can flow through the silencing valve even when the silencing valve is in the completely closed position.

18 Claims, 7 Drawing Sheets

(51) Int. Cl.

| | |
|---|---|
| ***F02D 9/04*** | (2006.01) |
| ***F02D 9/06*** | (2006.01) |
| ***F02D 9/10*** | (2006.01) |

(56) References Cited

U.S. PATENT DOCUMENTS

| | | | |
|---|---|---|---|
| 2015/0283897 | A1 | 10/2015 | Schiebeck |
| 2017/0067380 | A1 | 3/2017 | Cantrell |
| 2018/0223709 | A1 | 8/2018 | Pietila et al. |

FOREIGN PATENT DOCUMENTS

| | | | | |
|---|---|---|---|---|
| DE | 202017000834 | U1 | | 4/2017 |
| EP | 1445451 | A2 | | 11/2004 |
| JP | S62110521 | U | * | 7/1987 |
| JP | S62110521 | U | | 7/1987 |
| JP | 09158709 | A | * | 6/1997 |

OTHER PUBLICATIONS

Search Report issued in Italian Patent Application No. 201900013317, completed Feb. 24, 2020; 8 pages.
Search Report issued in European Patent Application No. 20188401.2-1004, dated Dec. 14, 2020; 7 pages.

* cited by examiner

EXHAUST SYSTEM FOR AN INTERNAL COMBUSTION ENGINE

CROSS-REFERENCE TO RELATED APPLICATIONS

This patent application claims priority from Italian patent application no. 102019000013317 filed on Jul. 30, 2019, the entire disclosure of which is incorporated herein by reference.

TECHNICAL FIELD

The invention relates to an exhaust system for an internal combustion engine.

PRIOR ART

An internal combustion engine is provided with an exhaust system, which has the function of releasing the gases produced by the combustion into the atmosphere limiting both the noise and the content of polluting substances. A modern exhaust system comprises: an exhaust duct, along which the exhaust gases coming from the internal combustion engine flow, a series of pollutant reducing devices (for example one or more monolithic catalysts and a particulate filter) arranged along the exhaust duct, and at least one silencer arranged along the exhaust duct downstream of the pollutant reducing devices.

Generally speaking, a silencer comprises a tubular body, which typically has an elliptical cross section and is provided with an inlet opening and with an outlet opening. Inside the tubular body there is defined a labyrinth, which determines a path for the exhaust gases from the inlet opening to the outlet opening; said labyrinth normally consists of diaphragms (or partitions), which are arranged crosswise (namely, perpendicularly to the longitudinal axis of the tubular body) so as to define chambers inside the tubular body, and of tubes, which connect the chambers to one another. In a traditional silencer ensuring a high damping of the noise at low rpms, the exhaust back pressure generated by the silencer (i.e. the loss of pressure caused in the exhaust gases when they flow through the silencer) exponentially grows as the number of revolutions per minute of the internal combustion engine increases (i.e. as the mean speed of the exhaust gases increases). As a consequence, in order to avoid too high exhaust back pressure values at high rpms, a bypass duct is provided, which is arranged in parallel to the silencer (namely, is designed to bypass the silencer) and is regulated by a bypass valve, which is kept closed at low rpms (so as to maximize the silencing action, sacrificing performances, which, anyway, are nor essential at low rpms) and is opened at high rpms (so as to reduce the exhaust back pressure, sacrificing the silencing, which should not be important when the internal combustion engine operates at high rpms).

Documents US2018223709A1, DE102009051098A1, US2015283897A1, US2017067380A1, U.S. Pat. No. 4,609,068A, DE202017000834U1 and EP1445451A2 describe an exhaust system for an internal combustion engine, which is provided with a silencing valve, which is movable between a completely open position and a completely closed position; in the completely closed position, the silencing valve has a free section for the passage of the exhaust gases having an area other than zero, so that the exhaust gases can flow through the silencing valve even when the silencing valve is in the completely closed position.

DESCRIPTION OF THE INVENTION

The object of the invention is to provide an exhaust system for an internal combustion engine, said exhaust system allowing for an ideal silencing at low rpms, allowing the exhaust back pressure to be minimized at high rpms, having a small weight as well as small dimensions and, at the same time, being easy and economic to be manufactured.

According to the invention, there is provided a an exhaust system for an internal combustion engine according to the appended claims.

The appended claims describe preferred embodiments of the invention and form an integral part of the description.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
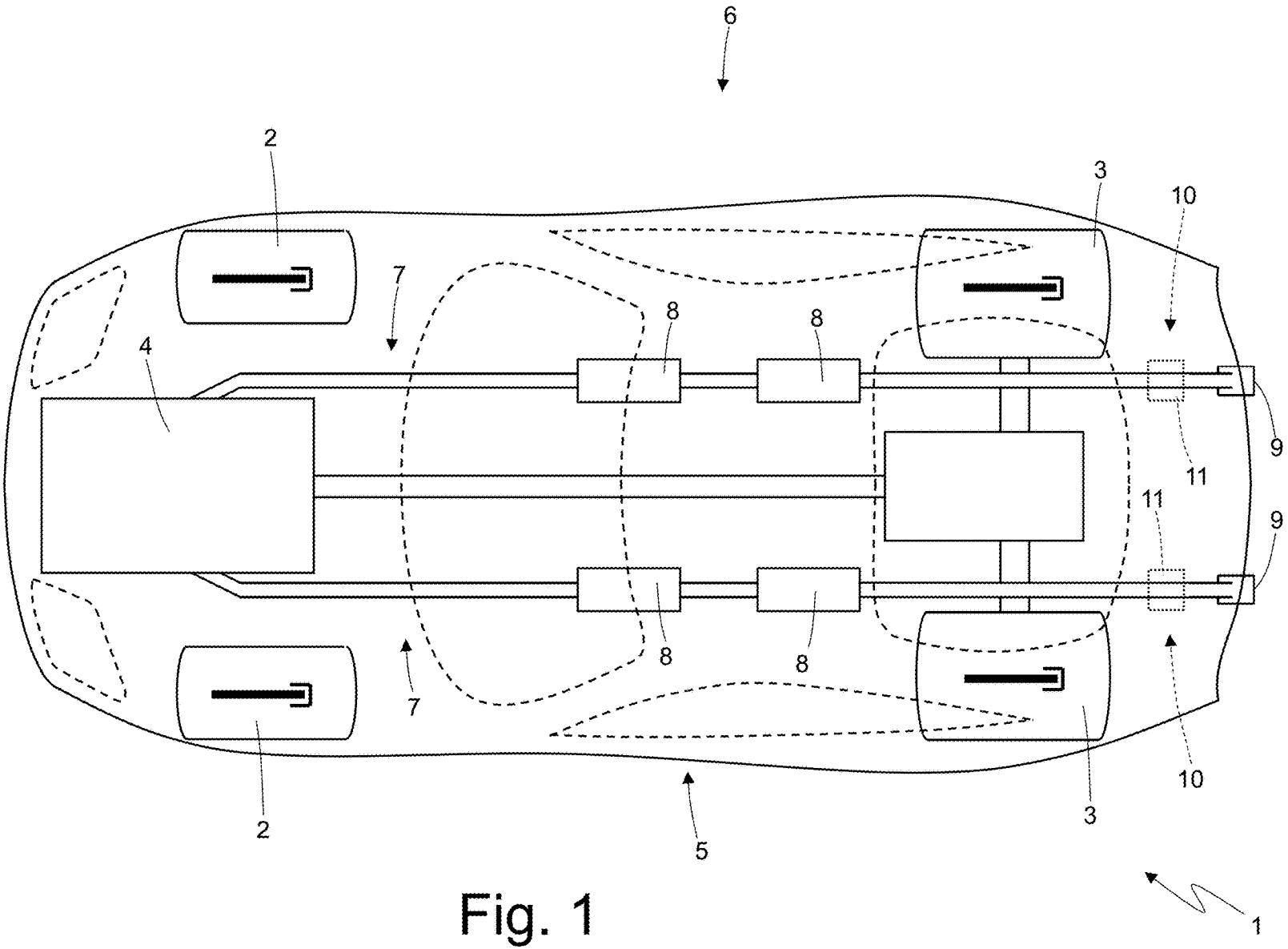
FIG. 1 is a schematic view of car, which is driven by an internal combustion engine provided with an exhaust system according to the invention.

In FIG. 1, number 1 indicates, as a whole, a car provided with two front wheels 2 and with two rear drive wheels 3, which receive the torque from an internal combustion engine 4 supercharged by means of a turbocharger and arranged in a front position. The car 1 is provided with a passenger compartment 5 which is designed to house the driver and possible passengers.

The internal combustion engine 4 is a "V8" engine and has two (twin) banks with four cylinders arranged at an angle relative to one another so as to form a "V". In each bank, the four cylinders are connected to an intake manifold (not shown) by means of two intake valves and to an exhaust manifold (not shown) by means of two exhaust valves; each exhaust manifold collects the gases produced by the combustion, which cyclically flow out of the exhaust valves.

The internal combustion engine 4 is provided with an exhaust system 6, which has the function of releasing the gases produced by the combustion into the atmosphere limiting both the noise and the content of polluting substances. The exhaust system 6 comprises two exhaust ducts 7, each originating from a corresponding exhaust manifold, so to receive the gases produced by the combustion from the exhaust manifold, and ending in the area of the tail of the car 1. ong each exhaust duct 7 there are known exhaust gas treatment devices 8: there always is at least one catalytic converter and there could also be a particular filter (in order to comply with the new EURO6C standards on polluting emissions, car manufacturers use a particulate filter—called GPF, which stands for "Gasoline Particulate Filter"—also in gasoline engines). At the end of each exhaust duct 7 there is a decorative tail pipe 9, which only fulfils decorative functions (namely, masking the exhaust duct 7 with a pleasant shape, which also matches the setting of the car 1).

Each exhaust duct 7 is provided with a silencing device 10, which is arranged along the exhaust duct 7 downstream of the exhaust gas treatment devices 8 and generally close to the end of the exhaust duct 7. According to FIG. 2, each silencing device 10 comprises a silencing valve 11, which intercepts the corresponding exhaust duct 7 (namely, is inserted inside the corresponding exhaust duct 7 so as to locally change the exhaust gas passage section).

Figure 2:
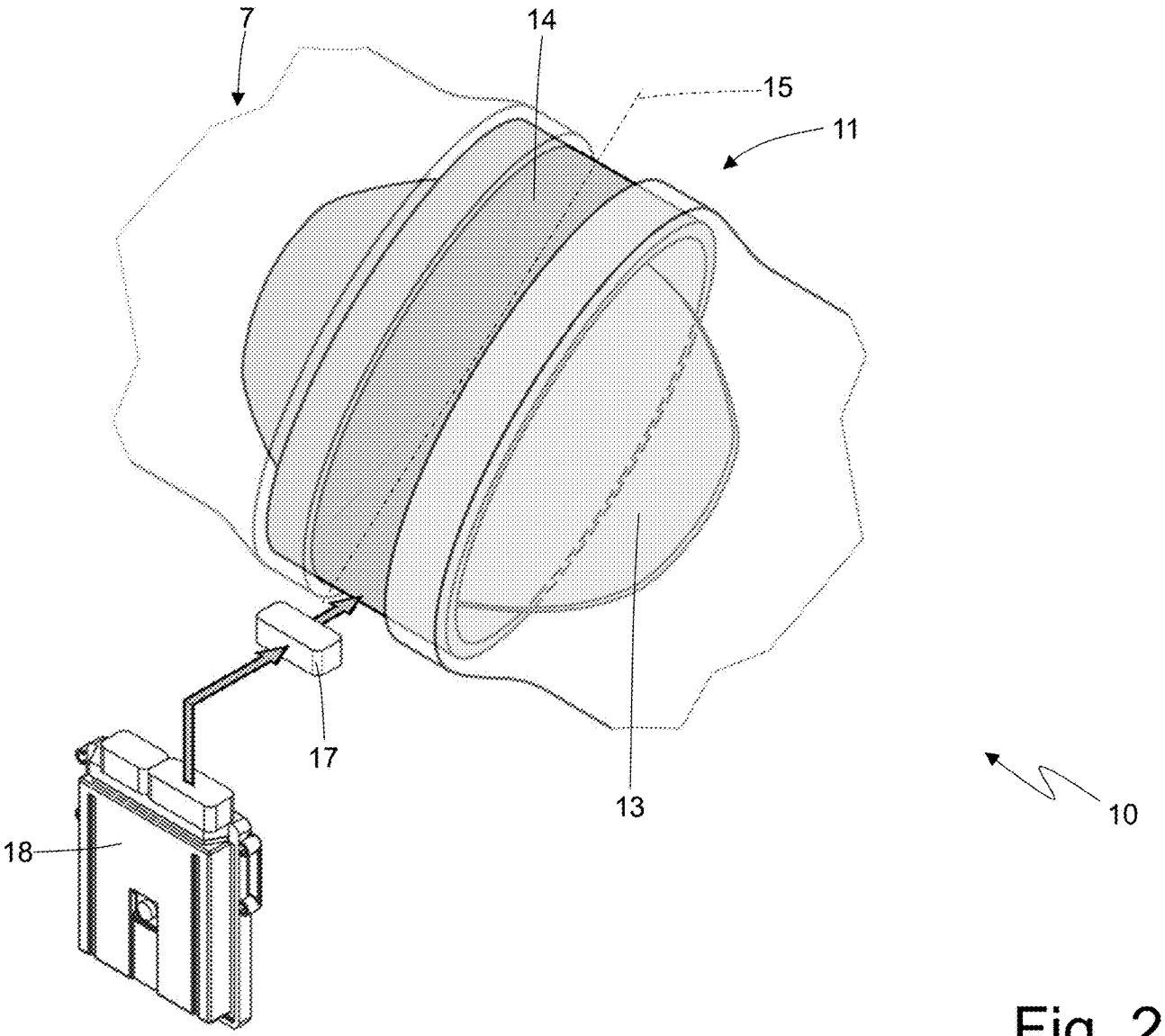
FIG. 2 is a schematic, perspective view of a silencing valve of the exhaust system of FIG. 1 in a completely open position.
Figure 3:
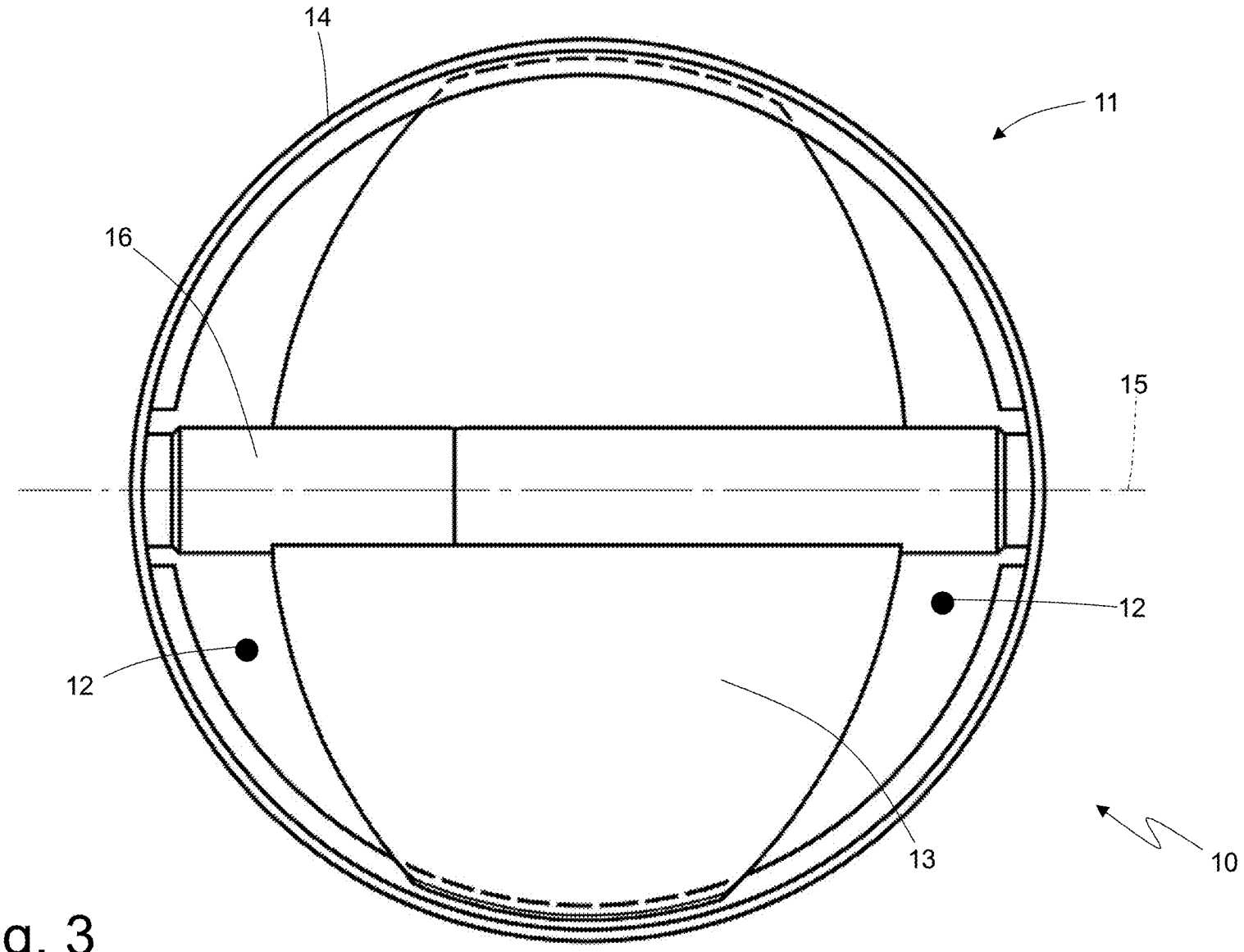
FIG. 3 is a front view of the silencing valve of FIG. 2 in a completely closed position.
Figure 4:
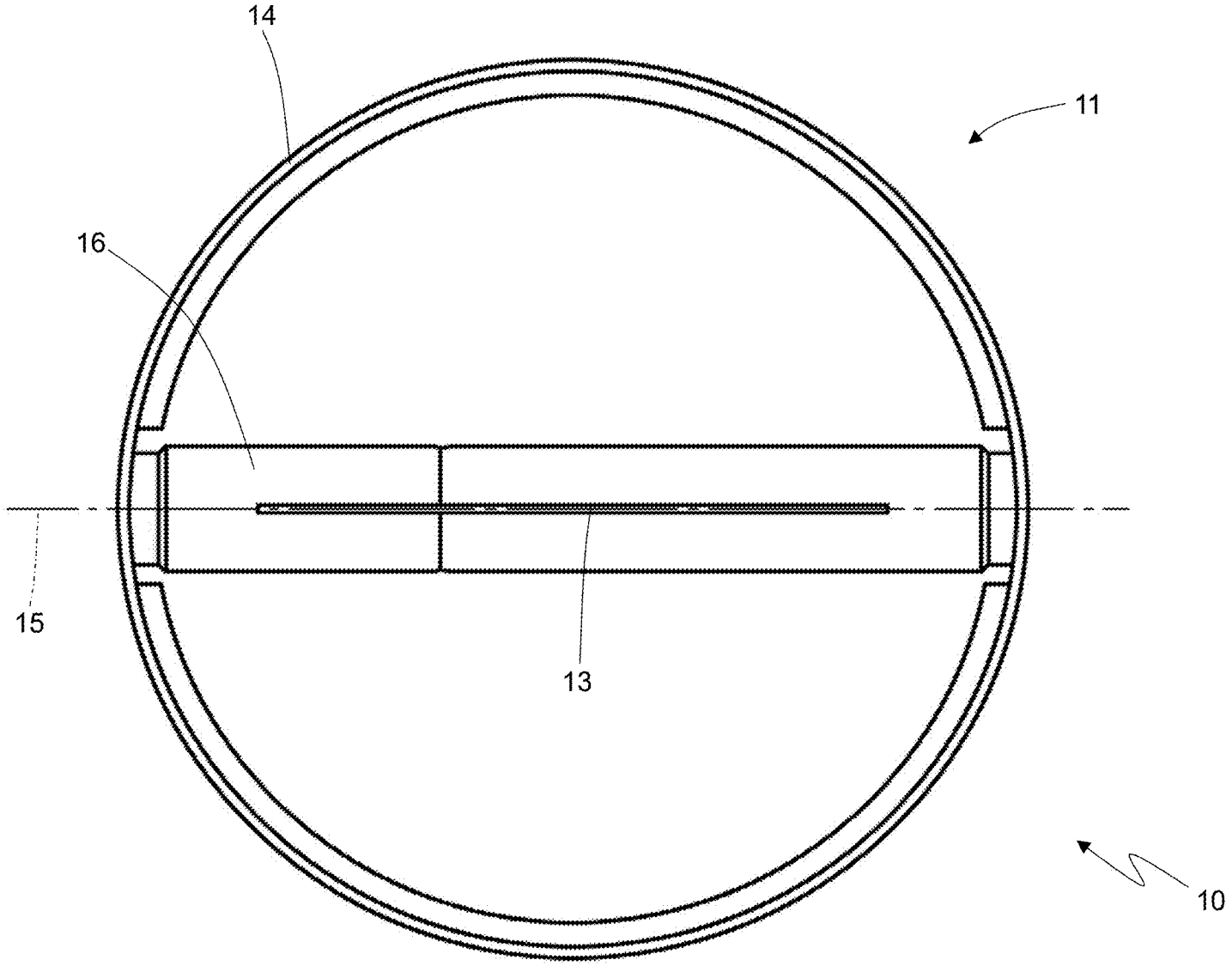
FIG. 4 is a front view of the silencing valve of FIG. 2 in a completely open position.

Each silencing valve 11 is movable between a completely open position (shown in FIGS. 2 and 4) and a completely closed position (shown in FIG. 3). In the completely closed position (shown in FIG. 3), each silencing valve 11 has a first (minimum) free section for the passage of the exhaust gases having an area A1 other than zero, so that the exhaust gases can flow through the silencing valve 11 even when the silencing valve 11 is in the completely closed position. In the completely open position (shown in FIGS. 2 and 4), each silencing valve 11 has a second free section for the passage of the exhaust gases having a (maximum) area A2. According to a preferred embodiment, the area A1 of the first free section (corresponding to the completely closed position) ranges from 8% to 24% of the area A2 of the second free section (corresponding to the completely open position).

The area A1 of the first free section (corresponding to the completely closed position) normally is at least equal to 220 $mm^2$ and generally ranges from 300 $mm^2$ to 750 $mm^2$.

Figure 5:
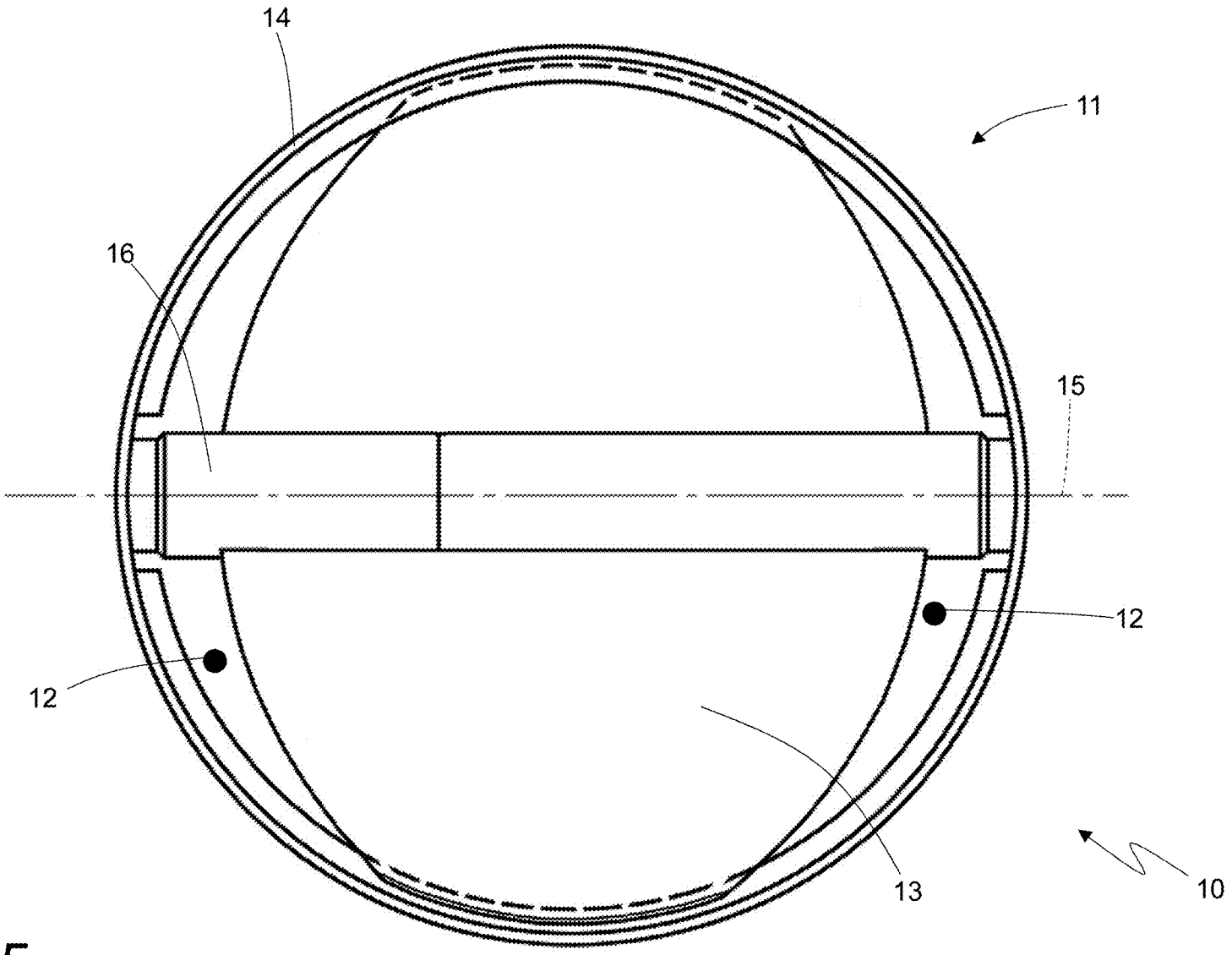
FIGS. 5 and 6 are two front views of respective variants of the silencing valve of FIG. 2 in a completely closed position.
Figure 6:
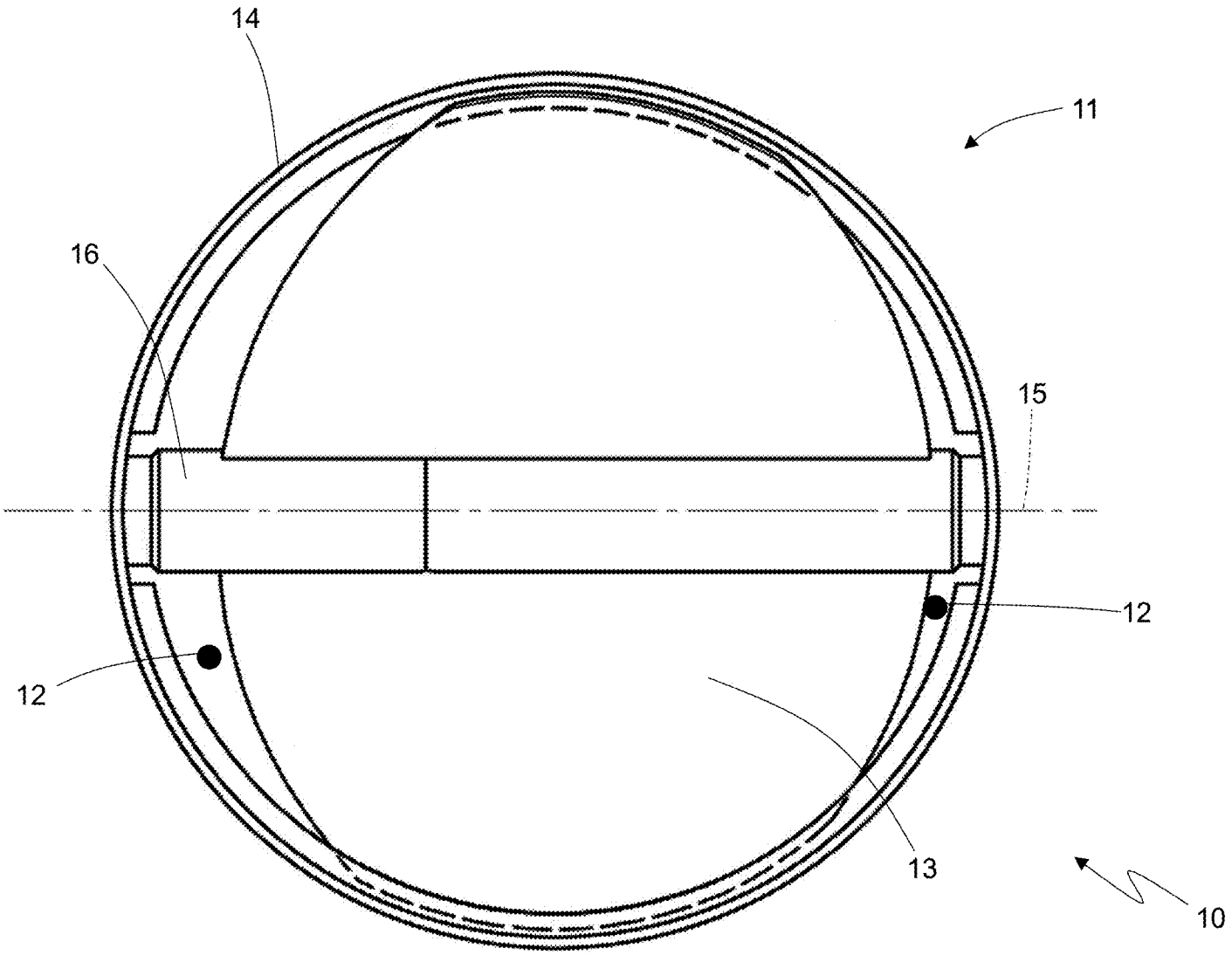

According to FIGS. 3, 5 and 6 (all showing a silencing valve 11 in the completely closed position), in the completely closed position, the first free section consists of two slits 12, which are separate from one another and are arranged at opposite ends of a shutter 13 of the silencing valve 11.

Each slit 12 of the first free section (corresponding to the completely closed position) preferably has the shape of a crescent of moon. The shape of a crescent of moon of the slits 12 making up the first free section (corresponding to the completely closed position) is particularly advantageous, as it prevents the exhaust gases from producing, by flowing through a silencing valve 11, whistles (or other unusual sounds), which could be extremely negative for they would (at least partly) jeopardize the silencing function of the silencing valve 11.

In the embodiments shown in FIGS. 3 and 5, the two slits 12 of the first free section (corresponding to the completely closed position) are mirror-like and have the same size; in the embodiment shown in FIG. 3, the area A1 of the first free section (corresponding to the completely closed position) is equal to approximately 640 $mm^2$, whereas, in the embodiment shown in FIG. 5, the area A1 of the first free section (corresponding to the completely closed position) is equal to approximately 320 $mm^2$. In the embodiment shown in FIG. 6, the two slits 12 of the first free section (corresponding to the completely closed position) have different sizes; for example, a slit 12 has a total area equal to 2-7 times a total area of the other slit 12.

According to FIGS. 2-6, each silencing valve 11 comprises a tubular body 14, which is flown through by the exhaust gases (namely, is inserted along the corresponding exhaust duct 7) and has a circular cross section; furthermore, each silencing valve 11 comprises the shutter 13, which is butterfly-shaped (namely, the shutter 13 is a butterfly plate), has an elliptical cross section and is mounted in a rotary manner inside the tubular body 14 so as to rotate around a rotation axis 15 arranged at the centre and oriented crosswise relative to the tubular body 14. As a consequence, in each silencing valve 11, the shutter 13 rotates around the rotations axis 15 between the completely open position (shown in FIGS. 2 and 4) and the completely closed position (shown in FIGS. 3, 5 and 6). Each shutter 13 has, at the centre, a cylindrical bulge, which constitutes a shaft 16, by means of which the shutter 13 is hinged at the two opposite ends so as to rotate around the rotation axis 15.

As already mentioned above, each shutter 13 has an elliptical shape having a larger size (along the main axis and oriented perpendicularly to the rotation axis 15) and a smaller size (along the minor axis and oriented parallel to the rotation axis 15): the larger size of each butterfly shutter 13 is equal to an inner diameter of the tubular body 14 and the smaller size of each butterfly shutter 13 is smaller than the inner diameter of the tubular body 14; in this way, in the completely closed position (shown in FIGS. 3, 5 and 6), each silencing valve 11 has the first (minimum) free section for the passage of the exhaust gases having an area A1 other than zero, so that the exhaust gases can flow through the silencing valve 11 even when the silencing valve 11 is in the completely closed position.

According to FIG. 2, each silencing valve 11 comprises an electric actuator 17, which is capable of placing and holding the silencing valve 11 in all the intermediate positions comprised between the completely open position (shown in FIGS. 2 and 4) and the completely closed position (shown in FIGS. 3, 5 and 6). Furthermore, a control unit 18 is provided, which is configured to change the position of each silencing valve 11 depending on a number of revolutions per minute and on a load of the internal combustion engine 4. According to a preferred embodiment, the control unit 18 is configured to change the position of each silencing valve 11 also depending on a gear engaged in a gearbox coupled to the internal combustion engine 4 and to change the position of each silencing valve 11 also depending on the driving mode selected by the driver (namely, it can be a sports driving mode, a racing driving mode, a city driving mode, a motorway driving mode, a wet-road driving mode . . . , which is generally selected by the driver by acting upon a selector called "hand lever").

According to a preferred embodiment, in the control unit 18 there are stored different maps (each corresponding to one or more driving modes), which provide, as an output, the desired (ideal) position of each silencing valve 11 based on the data provided as an input on the number of revolutions per minute and on the engine load of the internal combustion engine 4 as well as on the gear engaged in the gearbox coupled to the internal combustion engine 4.

Obviously, each map stored in the control unit 18 comprises a limited number of points and, therefore, the control unit 18 could carry out interpolations between the closest points of a map in order to determine the desired (ideal) position of each silencing valve 11.

The control unit 18 is configured to move each silencing valve 11 towards the completely closed position (namely, to close the silencing valve 11) in the presence of a small number of revolutions per minute and of small loads of the internal combustion engine 4 and to move the silencing valve 11 towards the completely open position (namely, to open the silencing valve 11) in the presence of a large number of revolutions per minute and of great loads of the internal combustion engine 4. Furthermore, the control unit 18 is configured to move each silencing valve 11 towards the completely closed position (namely, to close the silencing valve 11) when the low gears are engaged and to move the silencing valve 11 towards the completely open position (namely, to open the silencing valve 11) when the high gears are engaged.

Figure 7:
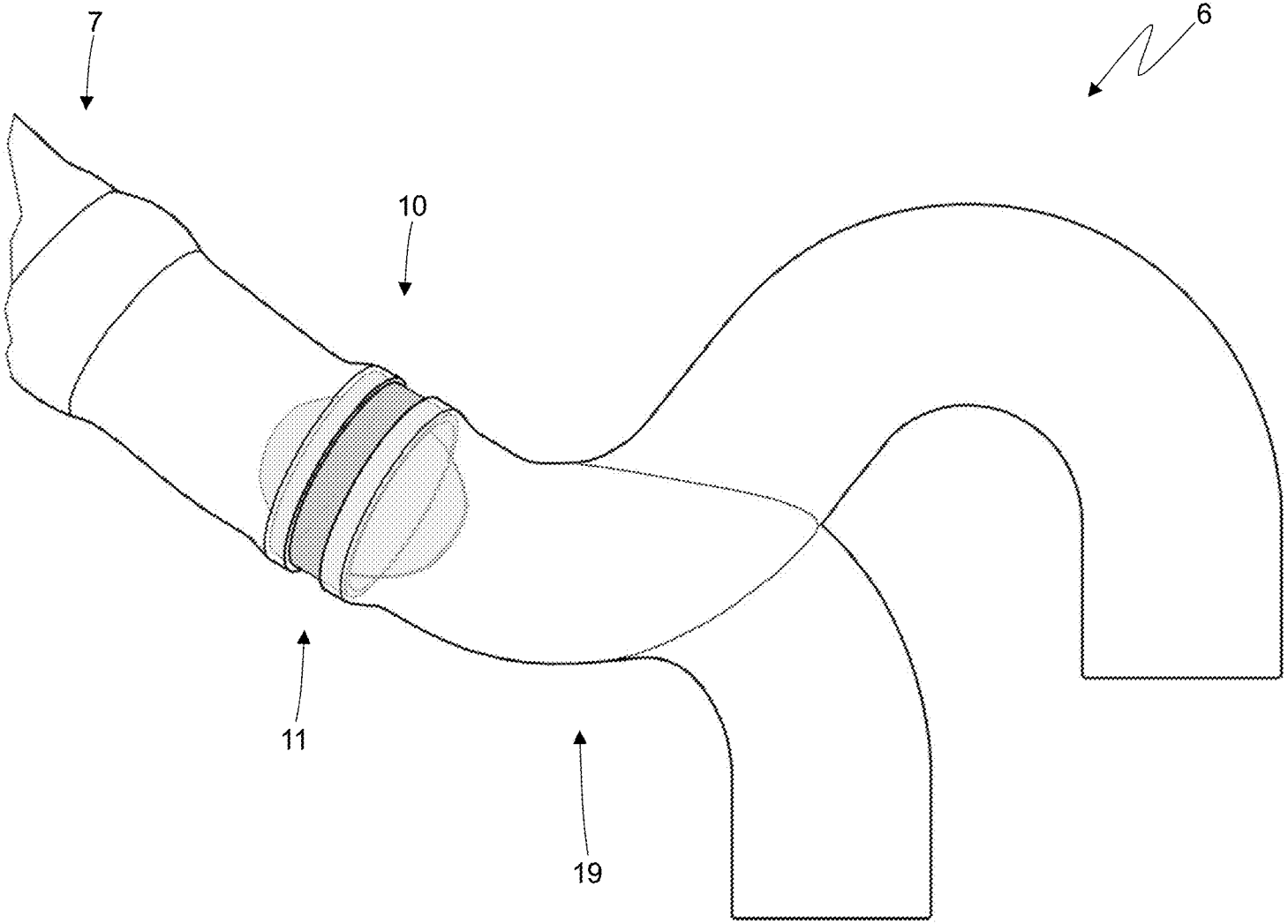
FIG. 7 is a schematic view of a variant of an end portion of the exhaust system of FIG. 1.

In the embodiment shown in FIG. 1, each exhaust duct 7 remains single also downstream of the silencing valve 11. On the contrary, in the variant shown in FIG. 7, downstream of the silencing valve 11 each exhaust duct 7 divides itself, namely has a bifurcation 19, downstream of which the exhaust duct 7 is double (and, hence, ends with two corresponding decorative tail pipes 9).

It should be pointed out that each silencing device 10 only and exclusively comprises the silencing valve 11, namely each silencing device 10 has no silencer arranged upstream or downstream of the silencing valve 11. Indeed, the functions of a traditional silencer and of the respective bypass duct are performed by the silencing valves 11.

In the completely open position (shown in FIGS. 2 and 4), each silencing valve 11 has the minimum exhaust back pressure (namely, allows performances to be maximized) and also has the minimum silencing ability (basically zero); on the other hand, in the completely closed position (shown in FIGS. 3, 5 and 6), each silencing valve 11 has the maximum exhaust back pressure (namely, jeopardizes performances to a greater extent) and also has the maximum silencing ability (basically equivalent to the silencing ability of a traditional silencer).

The control valve 18 is configured to close each silencing valve 11 (namely, to move each silencing valve 11 towards the completely closed position) when it is necessary (useful) to favour silencing rather than performances and to open each silencing valve 11 (namely, to move each silencing valve 11 towards the completely open position) when it is necessary (useful) to favour performances rather than silencing.

In the embodiments shown in the accompanying figures, the internal combustion engine 4 has eight cylinders 6 arranged in V shape. Obviously, the internal combustion engine could have a different number of cylinders and/or a different arrangement of the cylinders; in case of internal combustion engines with inline cylinders (hence, with one single bank of cylinders), there usually is one single exhaust duct 7 and, therefore, one single silencing device 10.

In the embodiments shown in the accompanying figures, the internal combustion engine 4 is supercharged; according to other embodiments which are not shown herein, the internal combustion engine 4 is not supercharged, namely is an aspirated engine.

The embodiments described herein can be combined with one another, without for this reason going beyond the scope of protection of the invention.

The exhaust system 6 described above has numerous advantages.

First of all, the exhaust system 6 described above allows for an ideal silencing at low rpms (keeping the silencing valves 11 completely closed) and, at the same time, allows the exhaust back pressure to be minimized at high rpms (keeping the silencing valves 11 completely open).

Furthermore, the exhaust system 6 described above is particularly light and compact, since it lacks the traditional silencer (which inevitably has a large volume) and the respective bypass duct, whose functions are carried out by the silencing valves 11, which have extremely small sizes.

Finally, the exhaust system 6 described above is easy and economic to be manufactured, since, compared to a similar traditional exhaust system 6, completely avoids the cost of the silencer (which, in a traditional exhaust system 6, is always combined with a bypass duct regulated by corresponding bypass valve having a cost that is similar to the cost of a silencing valve 11).

LIST OF THE REFERENCE NUMBERS OF THE FIGURES 1 car
2 front wheels
3 rear wheels
4 internal combustion engine
5 passenger compartment
6 exhaust system
7 exhaust duct
8 treatment devices
9 decorative tail pipe
10 silencing device
11 silencing valve
12 slits
13 shutter
14 tubular body
15 rotation axis
16 shaft
17 electric actuator
18 control unit
19 bifurcation

The invention claimed is:

1. An exhaust system (6) for an internal combustion engine (4); the exhaust system (6) comprises:

at least one exhaust duct (7), which originates from the internal combustion engine (4);

at least one exhaust gas treatment device (8), which is arranged along the exhaust duct (7);

a silencing device (10), which is arranged along the exhaust duct (7) downstream of the exhaust gas treatment device (8) and comprises a silencing valve (11), which intercepts the exhaust duct (7) and is movable between a completely open position and a completely closed position; and a control unit (18), which is configured to change the position of the silencing valve (11) depending on a number of revolutions per minute and on a load of the internal combustion engine (4);

wherein, in the completely closed position, the silencing valve (11) has a first free section for the passage of the exhaust gases having a first area (A1) other than zero, so that the exhaust gases can flow through the silencing valve (11) even when the silencing valve (11) is in the completely closed position;

wherein, in the completely closed position, the first free section consists of two slits (12), which are separate from one another and are arranged at opposite ends of a shutter (13) of the silencing valve (11);

wherein each slit (12) of the first free section has the shape of a crescent of moon;

wherein the two slits (12) of the first free section have different sizes;

wherein the control unit (18) is configured to move the silencing valve (11) towards the completely closed position in the presence of a small number of revolutions per minute and of small loads of the internal combustion engine (4) and to move the silencing valve (11) towards the completely open position in the presence of a large number of revolutions per minute and of great loads of the internal combustion engine (4); and wherein the silencing device (10) only and exclusively comprises the silencing valve (11) and has no silencer arranged upstream or downstream of the silencing valve (11).

2. The exhaust system (6) according to claim 1, wherein:

in the completely open position, the silencing valve (11) has a second free section for the passage of the exhaust gases having a second area (A2); and the first area (A1) of the first free section ranges from 8% to 24% of the second area (A2) of the second free section.

3. The exhaust system (6) according to claim 1, wherein the silencing valve (11) comprises:

a tubular body (14), which is flown through by the exhaust gases and has a circular cross section; and a butterfly shutter (13), which has an elliptical cross section and is mounted in a rotary manner inside the tubular body (14) so as to rotate around a rotation axis (15) arranged at the centre and oriented crosswise relative to the tubular body (14).

4. The exhaust system (6) according to claim 3, wherein a larger size of the butterfly shutter (13) is equal to an inner diameter of the tubular body (14) and a smaller size of the butterfly shutter (13) is smaller than the inner diameter of the tubular body (14).

5. The exhaust system (6) according to claim 1, wherein the silencing valve (11) comprises an actuator (17), which is capable of placing and holding the silencing valve (11) in all the intermediate positions comprised between the completely open position and the completely closed position.

6. The exhaust system (6) according to claim 1, wherein the control unit (18) is configured to change the position of the silencing valve (11) also depending on a gear engaged in a gearbox coupled to the internal combustion engine (4).

7. The exhaust system (6) according to claim 6, wherein the control unit (18) is configured to move the silencing valve (11) towards the completely closed position when low gears are engaged and to move the silencing valve (11) towards the completely open position when high gears are engaged.

8. An exhaust system (6) for an internal combustion engine (4); the exhaust system (6) comprises:

at least one exhaust duct (7), which originates from the internal combustion engine (4);

at least one exhaust gas treatment device (8), which is arranged along the exhaust duct (7); and a silencing device (10), which is arranged along the exhaust duct (7) downstream of the exhaust gas treatment device (8) and comprises a silencing valve (11), which intercepts the exhaust duct (7) and is movable between a completely open position and a completely closed position;

wherein, in the completely closed position, the silencing valve (11) has a first free section for the passage of the exhaust gases having a first area (A1) other than zero, so that the exhaust gases can flow through the silencing valve (11) even when the silencing valve (11) is in the completely closed position;

wherein, in the completely closed position, the first free section consists of two slits (12), which are separate from one another and are arranged at opposite ends of a shutter (13) of the silencing valve (11);

wherein each slit (12) of the first free section has the shape of a crescent of moon; and wherein the two slits (12) of the first free section have different sizes.

9. The exhaust system (6) according to claim 8, wherein the silencing device (10) only and exclusively comprises the silencing valve (11).

10. The exhaust system (6) according to claim 8, wherein the silencing device (10) has no silencer arranged upstream or downstream of the silencing valve (11).

11. The exhaust system (6) according to claim 8, wherein:

in the completely open position, the silencing valve (11) has a second free section for the passage of the exhaust gases having a second area (A2); and the first area (A1) of the first free section ranges from 8% to 24% of the second area (A2) of the second free section.

12. The exhaust system (6) according to claim 8, wherein the silencing valve (11) comprises:

a tubular body (14), which is flown through by the exhaust gases and has a circular cross section; and a butterfly shutter (13), which has an elliptical cross section and is mounted in a rotary manner inside the tubular body (14) so as to rotate around a rotation axis (15) arranged at the centre and oriented crosswise relative to the tubular body (14).

13. The exhaust system (6) according to claim 12, wherein a larger size of the butterfly shutter (13) is equal to an inner diameter of the tubular body (14) and a smaller size of the butterfly shutter (13) is smaller than the inner diameter of the tubular body (14).

14. The exhaust system (6) according to claim 8, wherein the silencing valve (11) comprises an actuator (17), which is capable of placing and holding the silencing valve (11) in all the intermediate positions comprised between the completely open position and the completely closed position.

15. The exhaust system (6) according to claim 8 and comprising a control unit (18), which is configured to change the position of the silencing valve (11) depending on a number of revolutions per minute and on a load of the internal combustion engine (4).

16. The exhaust system (6) according to claim 15, wherein the control unit (18) is configured to move the silencing valve (11) towards the completely closed position in the presence of a small number of revolutions per minute and of small loads of the internal combustion engine (4) and to move the silencing valve (11) towards the completely open position in the presence of a large number of revolutions per minute and of great loads of the internal combustion engine (4).

17. The exhaust system (6) according to claim 15, wherein the control unit (18) is configured to change the position of the silencing valve (11) also depending on a gear engaged in a gearbox coupled to the internal combustion engine (4).

18. The exhaust system (6) according to claim 17, wherein the control unit (18) is configured to move the silencing valve (11) towards the completely closed position when low gears are engaged and to move the silencing valve (11) towards the completely open position when high gears are engaged.

* * * * *